US006367626B1

(12) United States Patent
Muyskens

(10) Patent No.: US 6,367,626 B1
(45) Date of Patent: Apr. 9, 2002

(54) CLEARVIEW PACKAGING ASSEMBLY FOR BASILOID HANDLING OF IRREGULAR TOP APPLIANCES

(75) Inventor: David B. Muyskens, Hendersonville, TN (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 09/613,651

(22) Filed: Jul. 11, 2000

(51) Int. Cl.[7] ..... B65D 85/00
(52) U.S. Cl. ..... 206/320; 206/497; 206/586
(58) Field of Search ..... 206/320, 497, 206/586, 591, 592, 594, 597; 229/199, 199.1, 125.01, 919

(56) References Cited

U.S. PATENT DOCUMENTS

| | | | | | |
|---|---|---|---|---|---|
| 2,779,463 | A | | 1/1957 | Zimmerman | |
| 2,797,800 | A | | 7/1957 | Sider | |
| 2,972,440 | A | | 2/1961 | Munroe | |
| 3,162,351 | A | | 12/1964 | Rudofski | |
| 3,504,842 | A | * | 4/1970 | Grafslund | 206/320 |
| 3,616,986 | A | * | 11/1971 | Wolfe | 206/320 |
| 3,891,086 | A | | 6/1975 | Isaacs | |
| 4,260,071 | A | * | 4/1981 | Banburg et al. | 206/586 |
| 4,811,840 | A | | 3/1989 | Muyskens | |
| 5,131,541 | A | * | 7/1992 | Liebel | 206/586 |
| 5,277,310 | A | | 1/1994 | Mertz | |
| 5,289,969 | A | * | 3/1994 | Schwaner | 206/320 |
| 5,307,928 | A | | 5/1994 | Bishop | |
| 5,520,325 | A | | 5/1996 | Quaintance | |
| 5,535,941 | A | | 7/1996 | Garza | |
| 5,595,051 | A | | 1/1997 | Applegate | |
| 5,673,848 | A | | 10/1997 | Garza | |
| 6,155,419 | A | * | 12/2000 | Sowa | 206/320 |

* cited by examiner

*Primary Examiner*—Luan K. Bui
(74) *Attorney, Agent, or Firm*—Bullwinkel Partners, Ltd

(57) ABSTRACT

A Clearview packaging assembly for containing an irregular shaped appliance such as a washer or dryer is provided. The assembly comprises a clamshell-like framework placed around the appliance and wrapped tightly in transparent film. The framework includes a hinged top cap, front corner posts glued to the front portion of the top cap, rear corner posts glued to the rear portion of the top cap, front and rear bottom pieces glued to the lower ends of the corner posts, and a basiloid piece glued to the two rear corner posts. The top cap and the basiloid piece cooperate to form a three-layer thick basiloid handling flange to facilitate basiloid lifting of the packaging assembly with the appliance contained therein. The top cap has triangular shaped side walls that, along with the front corner posts, maintain the structural integrity of the package and prevent trapezoiding during basiloid handling.

13 Claims, 5 Drawing Sheets

CLEARVIEW PACKAGING ASSEMBLY FOR BASILOID HANDLING OF IRREGULAR TOP APPLIANCES

BACKGROUND

1. Field of the Invention

This patent relates to packaging for large appliances. More particularly, this patent relates to a Clearview packaging assembly for basiloid handling of appliances with irregular top surfaces.

2. Description of the Related Art

Large household appliances with irregular shapes, such as washers and dryers, traditionally have been packaged in large six-sided corrugated boxes. Such boxes protect the appliance from damage during shipping and handling and may be moved with the use of a standard forklift truck. The boxed appliances may be stacked if sufficient structural support is provided. This may be accomplished by inserting vertical support posts inside the corrugated box between the box interior walls and the appliance. Support posts may be positioned around the corners of the appliance and/or along the sides of the appliance. When packaged in a corrugated box of this type, the appliance is not visible.

See-through containers for large appliances have been proposed in U.S. Pat. Nos. 3,891,086, 4,811,840 and 5,307,928. These proposed see-through containers generally comprise top and bottom caps, corner support posts extending between the top and bottom caps, and heavy plastic see-through wrapping. The top and bottom caps may be secured to the support posts with horizontal retaining bands, as in U.S. Pat. No. 3,891,086, or vertical retaining bands, as in U.S. Pat. No. 5,307,928. When packaged in this way the appliances can be moved with standard fork lift trucks or with basiloid lift trucks.

A basiloid lift truck lifts an appliance container by the top cap instead of by the bottom of the container. Basiloid lift trucks have a vertically oriented lift blade extending from an upper frame that is secured to an elevator mechanism mounted on the front end of the lift truck. To lift an appliance having a top cap, the vertical blade is placed in flat contact with the side of the packaged appliance. As the elevator mechanism raises the lift blade, the top edge of the blade extends into the crease between the side of the package and the downwardly extending lip of the top cap. The lift blade is raised until a horizontal lifting bar mounted on the blade abuts the bottom edge of the top cap lip. The appliance can then be lifted off the floor by the elevator mechanism and moved. The lift blade must be slightly shorter than the top cap lip so that the blade does not pierce the top cap.

If the package is built properly, the force of the blade lifting at the top of the unit is transferred to the bottom of the unit. No significant force is applied to the front edge of the top cap opposite the basiloid blade. However, when a second packaged appliance is placed on top of the first unit, the weight of the top unit, since it is not all on top of the basiloid flap, tends to shift forward. As the weight of the top unit shifts forward, the front edge of the bottom unit top cap deflects downwardly, a phenomenon referred to as trapezoiding. As the front edge of the bottom unit deflects downwardly, the top unit tips forward and can fall off. The front edge of the top cap can deflect up to six inches or more, depending on the vertical space between the front edge of the top cap and the top surface of the irregular shaped appliance.

One method for preventing trapezoiding of packages containing irregular shaped appliances is to use a standoff made of a resilient material such as expanded polystyrene to take up the space between the top cap and the appliance top surface, thereby transferring the force from the top appliance directly to the top surface of the bottom appliance. However, standoffs waste material and put extra undue force on the bottom of the bottom package.

Thus it is an object of the present invention to provide a see-through packaging assembly that maintains its structural integrity during basiloid lifting and handling.

A further object of the present invention is to provide a packaging assembly for irregular shaped appliances that resists trapezoiding during basiloid lifting with a second unit on top.

A still further object of the present invention is to provide a packaging assembly having an integral basiloid flap formed by the cooperation of the top cap and a separate basiloid piece.

Another object of the present invention is to provide a clamshell-type packaging assembly that can be easily installed over an appliance mounted on a base pad.

Further and additional objects will appear from the description, accompanying drawings, and appended claims.

SUMMARY OF THE INVENTION

The present invention is a packaging assembly for an irregular top appliance, that is, an appliance having a relatively flat top surface and a raised portion extending above the top surface, typically in the rear. The packaging assembly comprises a clamshell-like framework that is glued together prior to installing it over the appliance, and a transparent polymer film wrapped tightly around the framework after it has been installed over the appliance.

The clamshell-like framework is made from a corrugated top cap, front and rear corner posts, two bottom pieces and a basiloid piece. The top cap has a large flat top panel, substantially triangular shaped side panels extending downward from opposite sides of the top panel, and a rear flap separated from the top panel by a fold line that functions as the clamshell hinge. The two front corner posts are glued to the triangular shaped side panels. The lower ends of the two front corner posts may be glued to one of the bottom pieces to form one half of the clamshell.

The basiloid piece has a rear panel and a basiloid flap separated by a fold line. The top cap rear flap and the basiloid flap are glued together to form a basiloid handling flange which facilitates lifting and moving of the packaging assembly with the appliance contained therein by a basiloid fork lift truck. The two rear corner posts are glued along their upper ends to the basiloid piece rear panel and along their lower ends to the second bottom piece to form the other half of the clamshell.

The clamshell framework can be easily installed over an appliance mounted on a base pad. The framework and appliance, except for the basiloid flap, is wrapped in a transparent polymer wrapping material, leaving much of the appliance visible. The basiloid flap is retained by a horizontal retaining band to from the completed structure.

With conventional see-through packages, the downward force caused by a second unit stacked on top during basiloid lifting can cause the front edge of the bottom unit top cap to deflect downward, a phenomenon referred to as trapezoiding. This deflection can continue until the front edge of the top cap meets the top surface of the bottom appliance, causing the top appliance to tip forward.

The present invention prevents such trapezoiding by providing substantially triangular-shaped side panels glued to the front corner posts. The front corner posts abut the front vertical corners of the appliance. During basiloid lifting of two stacked appliances, the downward force from the top unit to the front edge of the top cap is transferred to the front corner posts and then to the front vertical corners of the appliance. The front vertical corners prevent the corner posts and top cap from rotating about the clamshell hinge, thereby preventing the trapezoiding associated with conventional see-through appliance packages.

The front corner posts serve as an extension of the triangle defined by the top cap sidewalls, and serve to spread the force created by the top unit during basiloid lifting to an area along the entire front vertical edges of the bottom appliance. If the front corner posts are not glued to the top cap, the top cap could slide downward along the front corner posts, resulting in trapezoiding.

THE DRAWINGS

DETAILED DESCRIPTION OF THE INVENTION

Figure 1:
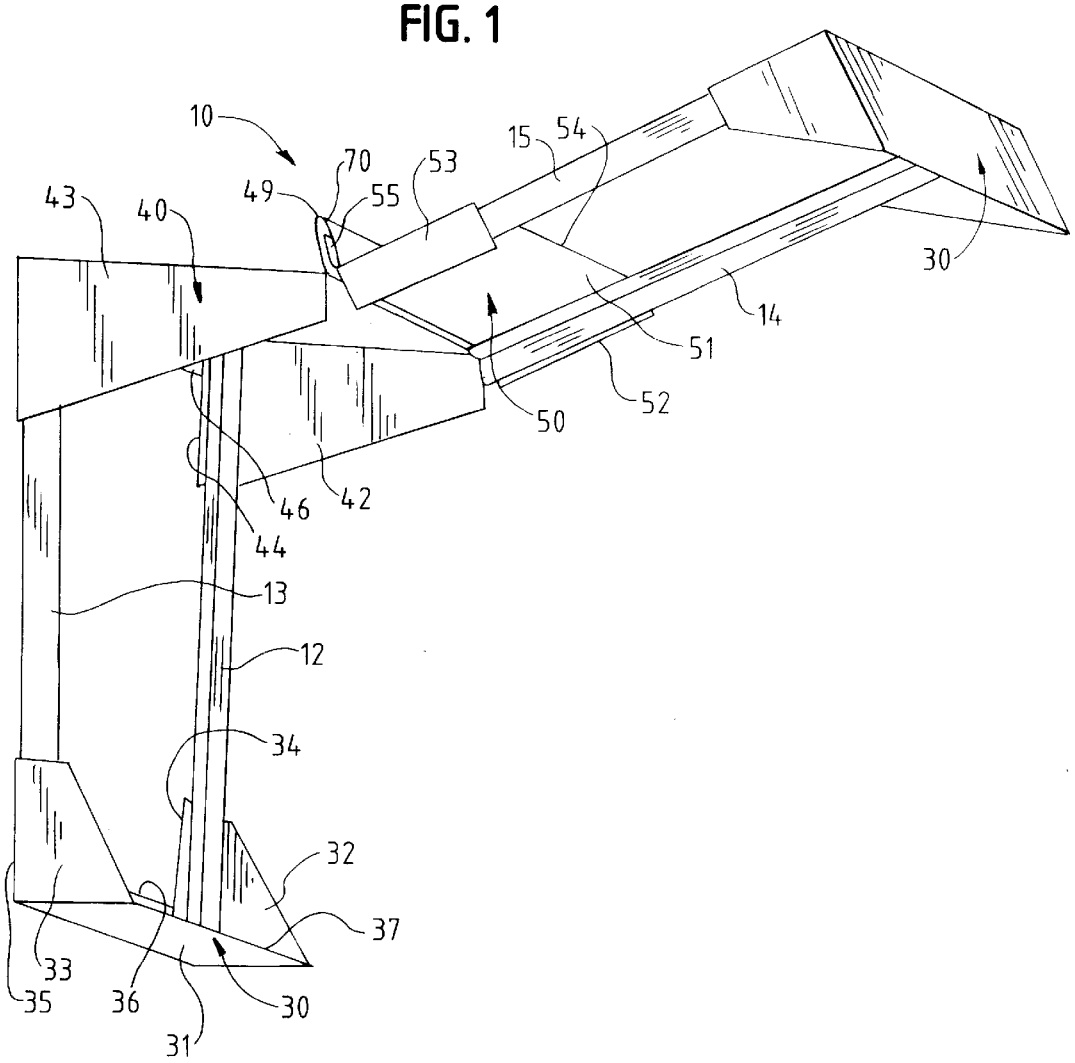
FIG. 1 is a perspective view of the packaging assembly framework of the present invention shown before installation over an appliance.

The present invention is a packaging assembly comprising a framework and transparent wrapping. Turning to the drawings, there is shown in FIG. 1 one embodiment of a framework made according to the present invention. The framework 10 is designed for basiloid handling of irregular top appliances, and comprises four structural support members 12, 13, 14 and 15, two bottom pieces 30, a top cap 40 and a basiloid flange piece 50. The assembly framework 10 has a two-piece hinged design that installs easily over an appliance 20.

Figure 5:
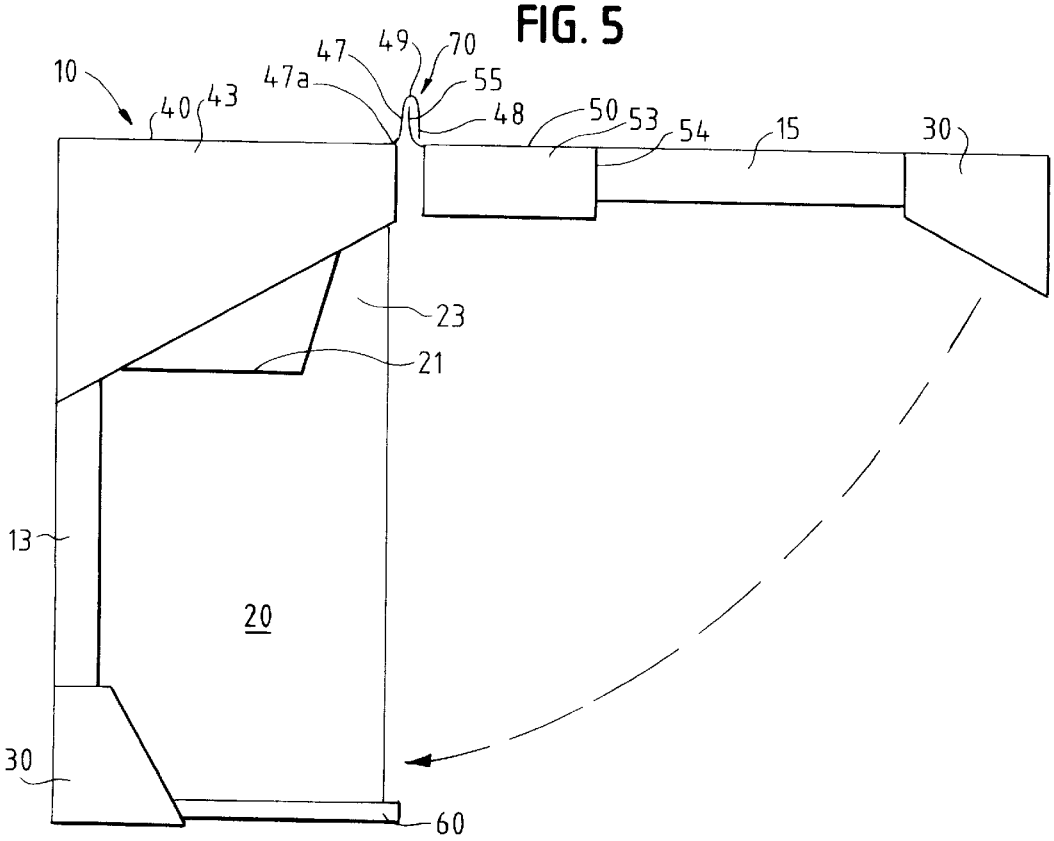
FIG. 5 is a side view of the packaging assembly framework of FIG. 1 shown partly installed over an appliance.

In one common anticipated application shown in FIG. 5, the appliance is mounted to a base pad 60 that supports the appliance 20 during assembly and handling. The base pad 60 may be formed of wood, paper and paperboard, expanded foam, or any other suitable material or combination of materials. The base pad may be made from a combination of low and high density materials, such as the type manufactured by Sonoco Products Company under the trademark Sonobase™M, which is the subject of a pending United States patent application.

Figure 6:
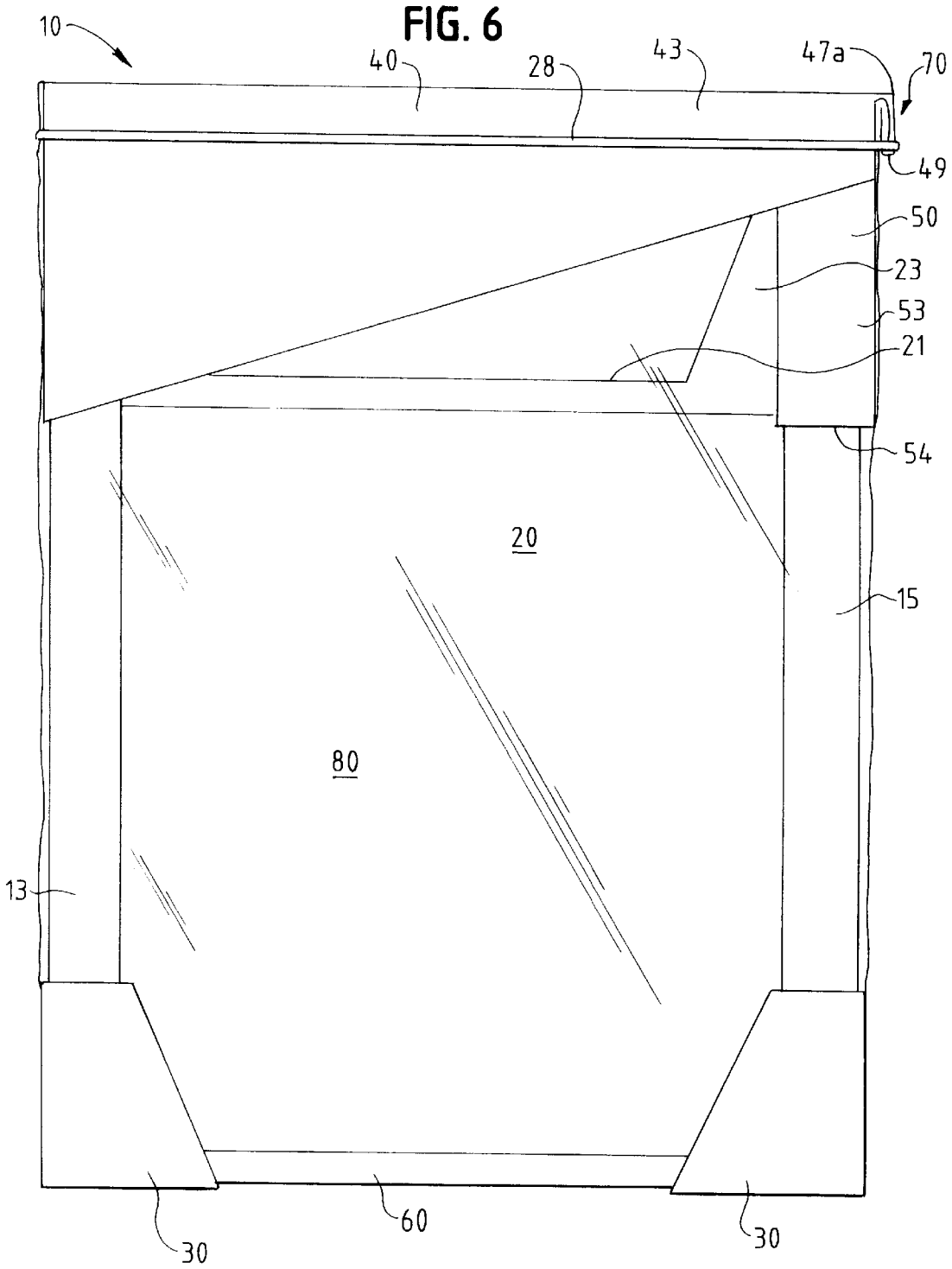
FIG. 6 is a side view of the packaging assembly framework of FIG. 1 shown containing an appliance and wrapped in transparent wrapping to form the complete packaging assembly.

After installation over an appliance, the packaging assembly framework 10, with the exception of the basiloid handling flange 70 to be described later, is wrapped in transparent plastic film 80 ("Clearview") that allows much of the appliance 20 to be seen (FIG. 6). A retaining band 28 is tightly wrapped around the top end of the top cap 40 and the basiloid handling flange 70 to maintain the flange 70 in the proper position during basiloid lifting and handling. The final packaging assembly, including the framework 10 and transparent wrapping 80, may be referred to as a Clearview basiloid pack.

For the purpose of the following description, the modifiers "left", "right", "front" and "rear" shall refer to the left, right, front and rear sides of the appliance to be packaged.

Figure 2:
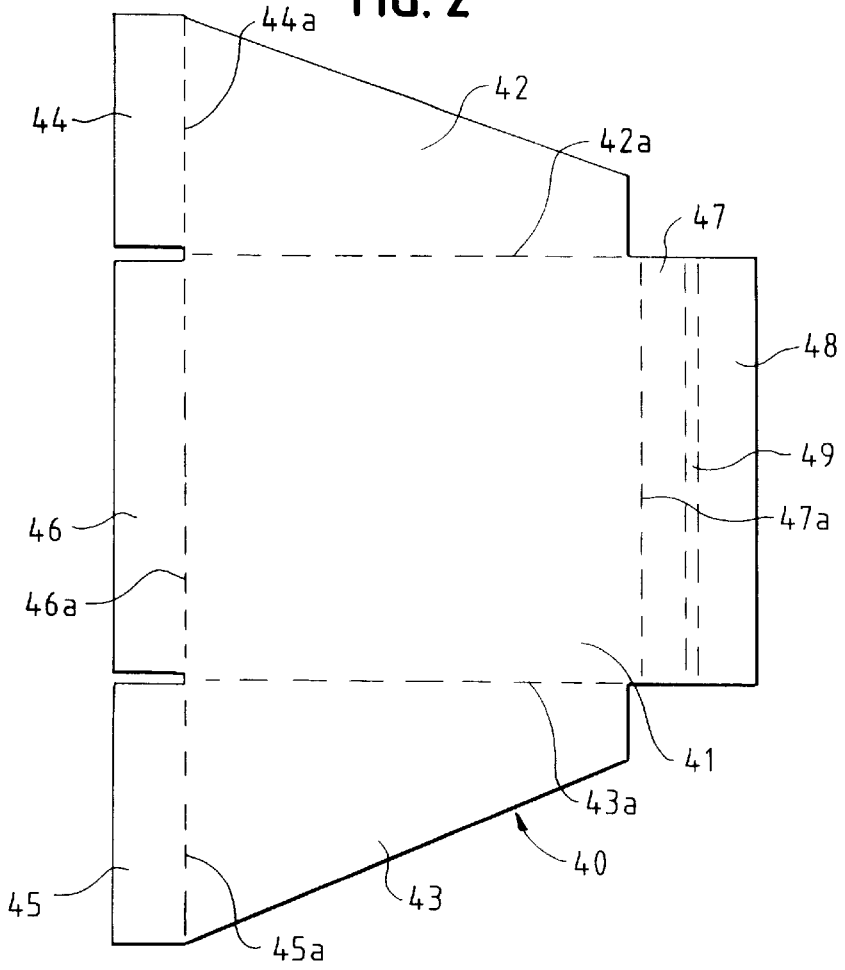
FIG. 2 is a top view of a blank from which the top cap of the present invention is formed.

FIG. 2 shows a cardboard blank used to form the top cap 40. The blank has a top panel 41 defined by fold lines 42*a*, 43*a*, 46*a* and 47*a*, the width and depth of the top panel being determined by the dimensions of the appliance to be packaged. In the assembled framework 10, left and right side panels 42, 43 extend downward from the top panel 41 and are glued to the two front corner posts 12, 13. Preferably the side panels 42, 43 are cut at an angle so that they are substantially triangular in shape, with their front edges extending farther down than their rear edges. Preferably, the front edges of the side panels 42, 43 extend near or below the plane defined by the top surface 21 of the appliance 20 (see FIGS. 5 and 6).

Referring again to FIG. 2, the left side panel 42 is folded along fold line 44*a* to create a left front flap 44 that is folded at a right angle to the top panel 41 and glued to the left front corner post 12. Likewise, the right side panel 43 is folded at a right angle along fold line 45*a* to create a right front flap 45 that is then glued to the right front corner post 13. A front panel 46 extends downward from the front edge 46*a* of the top panel 41 and is glued to the upper portions of the left and right front flaps 44, 45.

Figure 7:
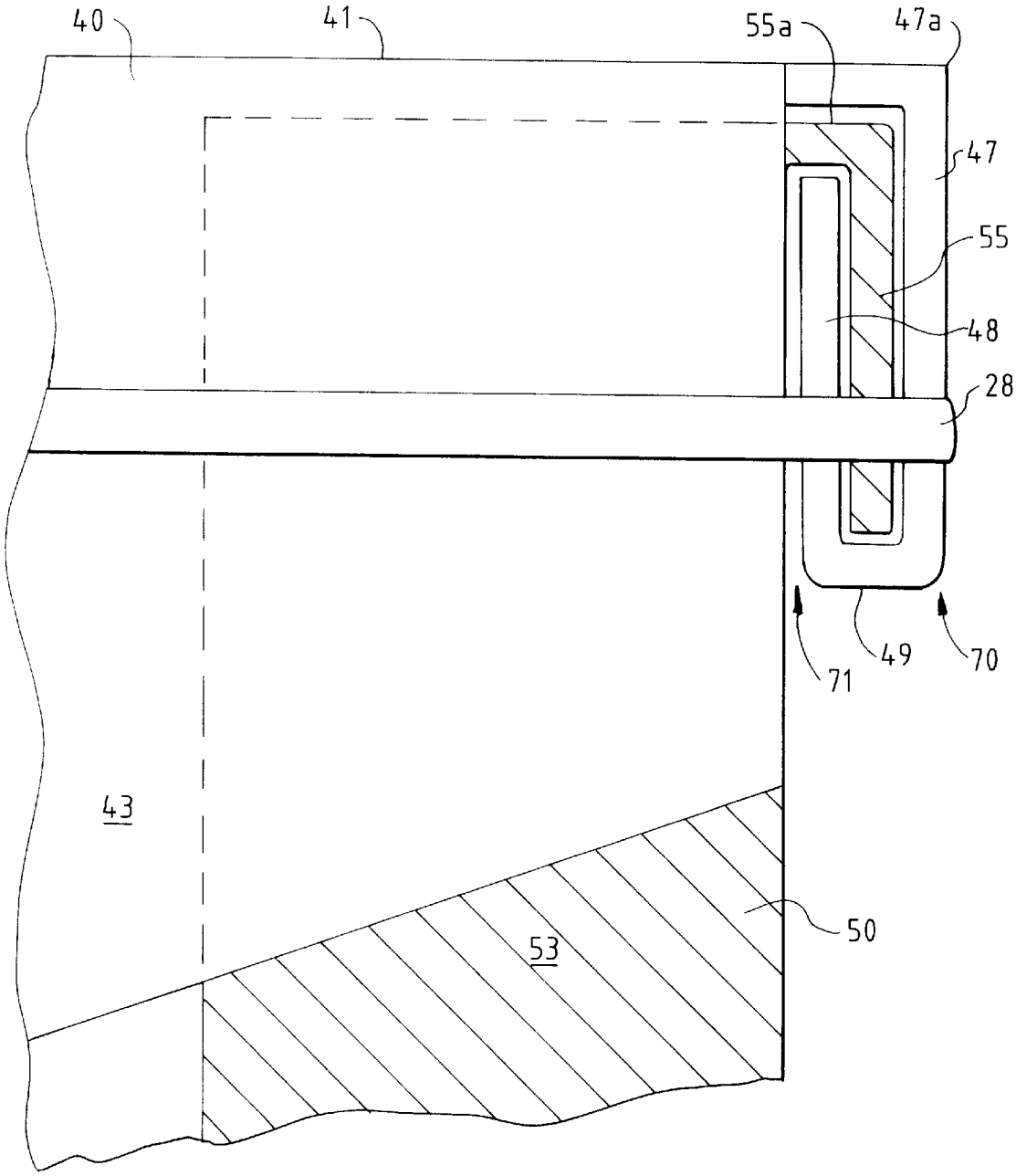
FIG. 7 is an enlarged view of a portion of the packaging assembly of FIG. 6.

Referring now to FIGS. 2 and 7, a fold line or hinge 47*a* separates the top panel 41 from a short rear flap 47. This hinge 47*a* allows for the framework's clamshell operation. After installing the framework 10 over an appliance 20, the short rear flap 47 extends downward from the top panel 41 and terminates at upturned edge 49. An inner flap 48, which is a continuation of the top panel 40, extends upward from the edge 49 parallel to rear flap 47, defining a space therebetween to accommodate a separate basiloid flap 55 as will now be described.

Figure 3:
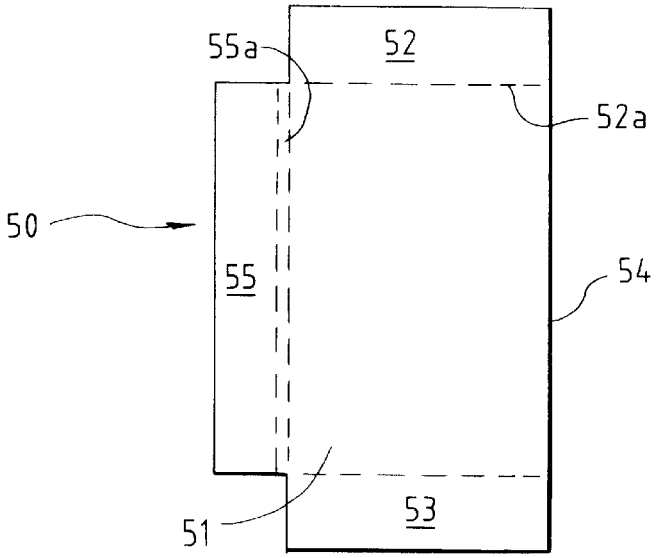
FIG. 3 is a top view of a blank from which the basiloid piece of the present invention is formed.

FIG. 3 is a top view of a blank used to form the basiloid piece 50. The blank has a rear panel 51 defined by fold lines 53*a*, 54*a*, a lower edge 54 and a down turned edge 55*a*. As shown in FIG. 6, the basiloid piece 50 preferably extends below the plane defined by the top surface 21 of the appliance 20. The basiloid piece 50 forms a three-sided shell around the rear elevated portion 23 of the irregular shaped appliance 20. In the assembled framework 10, left and right side flaps 52, 53 extend from the rear panel 51 and are glued to the upper portions of the rear left and right corner posts 14, 15 respectively.

As best shown in FIG. 7, a basiloid flap 55 extends downward between the rear flap 47 and the upturned inner flap 48 of the top cap 40 and is secured therebetween by glue or other adhesive means to form a basiloid handling flange 70. After the framework 10 is installed over an appliance 20 and wrapped in transparent film 80, a retainer band 28 is wrapped tightly around the upper portion of the assembly to retain the basiloid handling flange 70. The basiloid flange 70 is three layers thick and has a lower edge 49 that bears the lifting force of a basiloid blade.

The basiloid handling flange 70 preferably extends about six to fourteen inches downward from the top panel 41 and is held in place by the retaining band 28. The purpose of the flap 70 is to accommodate the basiloid lifting blade of a basiloid fork lift truck. The basiloid blade (not shown) is inserted into the slot 71 between the basiloid flange 70 and the rear panel 51 of the basiloid piece 50. The basiloid blade has a rounded top edge so that the forklift operator doesn't inadvertently hook the blade into the plastic film cover 70 and rear panel 51 of the basiloid piece 50. The basiloid blade is slightly shorter than the length of the basiloid flange 70 so that, when fully inserted into slot 71, the top edge of the blade does not pierce upper edge 55*a* of the basiloid flap 55.

When fully installed, a horizontal bar mounted on the basiloid blade abuts the lower edge 49 of the basiloid flap 55 to lift the package and appliance. The retaining band 28 keeps the basiloid flap 55 in position during lifting.

Figure 4:
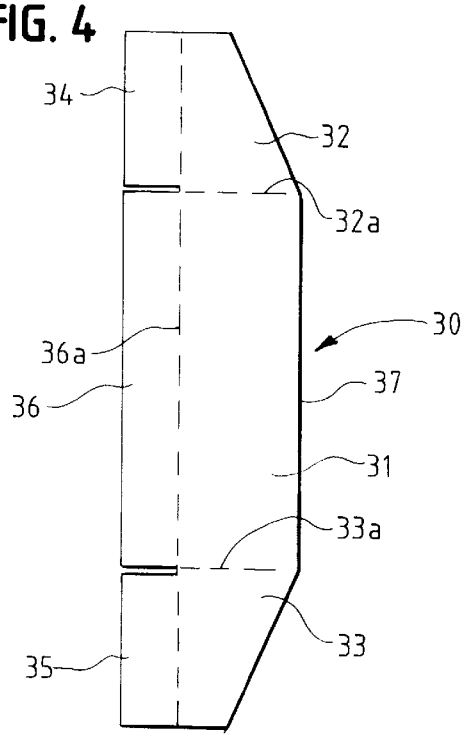
FIG. 4 is a top view of a blank from which the bottom pieces of the present invention are formed.

FIG. 4 shows a cardboard blank used to form each of the bottom pieces 30. The blank has a bottom panel 31 defined by fold lines 32*a*, 33*a*, 36*a* and edge 37. As shown in FIG. 1, and with respect to the front bottom piece 30, side panels 32, 33 extend upward from the bottom panel 31 and are glued to the sides of lower portions of the front left and front right corner posts 12, 13 respectively. The left and right side flaps 32, 33 are folded at about a ninety degree angle to form front flaps 34, 35 which are glued to the lower front surfaces of the front corner posts 12, 13. A front flap 36 extends upward from the bottom panel 31 and is glued to the lower outer surfaces of the front flaps 34, 35. A similar blank is used to make the rear bottom piece 30 which is glued to the rear corner posts 14, 15.

To assemble the packaging framework 10, the four corner posts 12, 13, 14 and 15, two bottom pieces 30, top cap 40, and basiloid flange piece 50 are glued together as shown in FIG. 1 to form the packaging framework 10. The packaging framework 10 is then slipped onto an appliance 20 resting on a base pad 60 in clamshell fashion as shown in FIG. 5. With the basiloid handling flange 70 extending generally horizontally, a tight clear poly covering 80 is wrapped around the appliance 20 and package framework 10. When the wrapping process is complete, the basiloid handling flange 70 is folded down to the position shown in FIGS. 6 and 7 and the metal or plastic retaining band 28 is wrapped tightly around the top of the Clearview basiloid pack.

When installed around an appliance 20, the packaging assembly is resistant to the trapezoiding phenomenon that can occur when irregular shaped appliances are packaged inside conventional appliance packages, stacked one on top of the other, and lifted with a basiloid blade. This resistance to trapezoiding is due to the unique structure and geometry of the Clearview basiloid package.

An important feature of the package assembly is the substantially triangular-shaped sidewalls 42, 43 that extend downward to an area near or below that top surface of the appliance 20. The top cap and sidewalls are glued to the front corner posts 12, 13 which abut the front vertical corners of the appliance 20, thereby resisting rotation of the top cap side walls 42, 43 about the hinge 47*a*. Preferably, the triangular shaped side panels 42, 43 extend below the top surface of the appliance 20, but the system is also operable if the side panels 42, 43 extend downward to an area slightly above the top surface.

The front corner posts 12, 13 serve as an extension of a side of the triangle defined by the top cap side panels 42, 43. Gluing the top cap 40 to the front corner posts 12, 13 prevents the top cap from sliding down the corner posts 12, 13, which would result in trapezoiding. During basiloid lifting, the corner posts 12, 13 spread the downward force caused by the top appliance unit to those areas along the front vertical edges of the bottom appliance 20 that contact the corner posts 12, 13.

During basiloid lifting of two stacked appliances, the downward force from the top unit along the front edge of the top cap 40 is transferred to the front corner posts 12, 13 and then to the front vertical corners of the appliance 20. The front vertical corners prevent rotation of the corner posts 12, 13 and the top cap 40 glued thereto. Thus the trapezoiding associated with conventional see-through appliance packages is avoided.

Preferably, the bottom pieces 30, top cap 40 and basiloid piece 50 are made from corrugated board, although other suitable materials may be used. In the preferred embodiment the corner posts 12, 13, 14 and 15 are formed of multiple sheets of paper laminated together in a sufficient number of layers to provide adequate structural strength. Other corner post materials are contemplated, such as convolutely wound paperboard, recycled paper, treated paper, mixtures of paper and paperboard, and corrugated board. The corner posts must be able to be glued to the top cap. The corner posts 12, 13, 14 and 15 may be of the type manufactured by Sonoco Products Company of Hartsville, S.C. under the trademark Sonopost.

Thus there has been described a Clearview packaging assembly for basiloid handling of irregular top appliances that prevents trapezoiding of the package when picked up by a basiloid fork lift truck with another packaged appliance on top. The packaging assembly prevents trapezoiding without using the top of the appliance for support.

Other modifications and alternative embodiments of the invention are contemplated which do not depart from the spirit and scope of the invention as defined by the foregoing teachings and appended claims. It is intended that the claims cover all such modifications that fall within their scope.

I claim as my invention:

1. A packaging assembly for an irregular top appliance, said appliance having a top surface and a raised portion extending above the top surface, said packaging assembly comprising a framework having:

a top cap having a top panel, side panels extending downward therefrom, and a rear portion extending downward from the top panel and then folded inwardly on itself to define a slot;

front and rear bottom pieces;

two front corner posts extending between the top cap and the front bottom piece and having upper and lower ends, said upper ends of the front corner posts being glued to the top cap side panels and said lower ends of the front corner posts being glued to the front bottom piece;

two rear corner posts extending between the top cap and the rear bottom piece and having upper and lower ends, the lower ends of said rear corner posts being glued to the rear bottom piece; and a basiloid piece having a rear panel glued to the upper ends of the rear corner posts, said basiloid piece having a basiloid flap extending from the rear panel along a fold line and glued to the top cap rear portion to form a basiloid handling flange to facilitate lifting and moving of the packaging assembly with the appliance contained therein by a basiloid forklift truck.

2. The packaging assembly of claim 1 further comprising transparent polymer wrapping wrapped tightly around the entire framework and appliance except for the basiloid handling flange.

3. The packaging assembly of claim 2 further comprising a retaining band tightly wrapped around the top cap and basiloid handling flange to retain the basiloid handling flange during basiloid handling.

4. The packaging assembly of claim 1 wherein the basiloid flap is inserted into the slot defined by the top cap rear portion.

5. The packaging assembly of claim 1 wherein the top cap side panels extend below a plane defined by the top surface of the appliance.

6. The packaging assembly of claim 1 wherein the top cap side panels are substantially triangular in shape, said side panels having front and rear edges, said front edges extending farther down than the rear edges and below a plane defined by the top surface of the appliance.

7. A framework for packaging an irregular top appliance having front and rear sides, a top surface, a raised portion extending above the top surface near the rear side, and two front vertical corners, said packaging framework comprising:

a top cap having a top panel, substantially triangular side panels extending downward therefrom, and a rear portion separated from the top panel by a hinge and extending downward from the top panel and then folded inwardly on itself along an upturned edge to define a slot;

two front corner posts glued to the top cap and extending downward therefrom, said front corner posts abutting the front vertical corners of the appliance;

a basiloid piece having a rear panel adjacent the appliance rear side and a basiloid flap extending from the rear panel along a fold line and glued inside the slot defined by the top cap rear portion to form a basiloid handling flange;

wherein downward force on a portion of the top cap positioned over the appliance front side caused by a second packaged appliance stacked on top during basiloid lifting is transferred to the front corner posts and then to the front vertical corners of the appliance, thereby preventing downward deflection of the top cap portion.

8. A framework for packaging an irregular top appliance, said appliance having front and rear sides and a top surface, said packaging framework comprising:

a top cap having a top panel and a rear panel hingedly connected to each other and side walls hingedly connected to the top panel;

a structural support member connected to each of the side panels and being positioned adjacent the appliance front side;

a basiloid piece connected to the rear panel and forming a basiloid handling flange therewith, said basiloid piece being positioned adjacent the appliance rear side; and rear structural support members connected to the basiloid piece and being positioned adjacent the appliance rear side.

9. The packaging assembly of claim 8 further comprising transparent polymer wrapping wrapped tightly around the entire framework and appliance except for the basiloid handling flange.

10. The packaging assembly of claim 9 further comprising a retaining band tightly wrapped around the top cap and basiloid handling flange.

11. The packaging assembly of claim 8 wherein the top cap rear panel is folded 180 degrees inwardly to define a slot, and the basiloid piece comprises a flap that is inserted into the slot and glued to the rear panel.

12. The packaging assembly of claim 8 wherein the side panels extend below a plane defined by the top surface of the appliance.

13. The packaging assembly of claim 8 wherein each side panel is substantially trapezoidal in shape and has front and rear vertical parallel edges, said front vertical edge being longer than the rear vertical edge and terminating below the plane defined by the top surface of the appliance.

* * * * *